US008218318B2

(12) United States Patent
Aarts et al.

(10) Patent No.: US 8,218,318 B2
(45) Date of Patent: Jul. 10, 2012

(54) LOW NOISE COOLING DEVICE

(75) Inventors: Ronaldus Maria Aarts, Eindhoven (NL); Clemens Johannes Maria Lasance, Eindhoven (NL); Joris Adelbert Maria Nieuwendijk, Eindhoven (NL); Okke Ouweltjes, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 124 days.

(21) Appl. No.: 12/746,200

(22) PCT Filed: Nov. 26, 2008

(86) PCT No.: PCT/IB2008/054957

§ 371 (c)(1),
(2), (4) Date: Jun. 4, 2010

(87) PCT Pub. No.: WO2009/072033

PCT Pub. Date: Jun. 11, 2009

(65) Prior Publication Data

US 2010/0243217 A1 Sep. 30, 2010

(30) Foreign Application Priority Data

Dec. 7, 2007 (EP) ..... 07122620

(51) Int. Cl.
*H05K 7/20* (2006.01)

(52) U.S. Cl. ..... 361/691; 361/689; 361/710; 165/80.3; 165/122; 417/410.2; 417/413.2

(58) Field of Classification Search ..... 361/679.46, 361/676, 688–695, 701–704, 707, 709–710
See application file for complete search history.

(56) References Cited

U.S. PATENT DOCUMENTS

| | | | | |
|---|---|---|---|---|
| 5,894,990 | A * | 4/1999 | Glezer et al. | 239/423 |
| 6,937,472 | B2 * | 8/2005 | Pokhama | 361/700 |
| 7,263,837 | B2 * | 9/2007 | Smith | 62/6 |
| 2004/0202558 | A1 * | 10/2004 | Fong et al. | 417/413.2 |
| 2005/0121171 | A1 * | 6/2005 | Mukasa et al. | 165/80.3 |
| 2006/0237171 | A1 | 10/2006 | Mukasa et al. | |
| 2006/0239844 | A1 | 10/2006 | Nakayama | |
| 2006/0245163 | A1 | 11/2006 | Mukasa | |
| 2006/0245614 | A1 | 11/2006 | Ishikawa | |
| 2006/0281398 | A1 | 12/2006 | Yokomizo et al. | |
| 2007/0081027 | A1 | 4/2007 | Beltran et al. | |
| 2009/0168343 | A1 * | 7/2009 | Aarts et al. | 361/689 |

FOREIGN PATENT DOCUMENTS

| | | | |
|---|---|---|---|
| EP | 1762725 | A1 | 3/2007 |
| WO | 2005008348 | A2 | 1/2005 |
| WO | 2007107921 | A2 | 9/2007 |

* cited by examiner

*Primary Examiner* — Courtney Smith
(74) *Attorney, Agent, or Firm* — Mark L. Beloborodov

(57) ABSTRACT

A cooling device (1) using pulsating fluid for cooling of an object, comprising: a transducer (2) having a membrane adapted to generate pressure waves at a working frequency ($f_w$), and a cavity (4) enclosing a first side of the membrane. The cavity (4) has at least one opening (5) adapted to emit a pulsating net output fluid flow towards the object, wherein the opening (5) is in communication with a second side of the membrane. The cavity (4) is sufficiently small to prevent fluid in the cavity (4) from acting as a spring in a resonating mass-spring system in the working range. This is advantageous as a volume velocity ($u_1$) at the opening is essentially equal to a volume velocity ($u_1'$) at the second side of the membrane, apart from a minus sign. Thus, at the working frequency the pulsating net output fluid can be largely cancelled due to the counter phase with the pressure waves on the second side of the membrane resulting in a close to zero far-field volume velocity. Thus a low sound level is achieved, at a low cost, without requiring mechanical symmetry.

8 Claims, 4 Drawing Sheets

LOW NOISE COOLING DEVICE

TECHNICAL FIELD

The present invention relates to a cooling device using pulsating fluid for cooling of an object, comprising: a transducer having a membrane adapted to generate pressure waves at a working frequency ($f_w$), and a cavity enclosing a first side of the membrane, the cavity having at least one opening adapted to emit a pulsating net output fluid flow towards the object, wherein the opening is in communication with a second side of the membrane.

The present invention further relates to an electronic device and an illumination device comprising such a cooling device.

BACKGROUND OF THE INVENTION

The need for cooling has increased in various applications due to higher heat flux densities resulting from newly developed electronic devices, being, for example, more compact and/or higher power than traditional devices. Examples of such improved devices include, for example, higher power semiconductor light-sources, such as lasers or light-emitting diodes, RF power devices and higher performance microprocessors, hard disk drives, optical drives like CDR, DVD and Blue ray drives, and large-area devices such as flat TVs and luminaires.

As an alternative to cooling by fans, document US 2006/0237171 discloses a jet generating device comprising a vibrating member and a housing having a nozzle and a first chamber containing the gas. The jet generating device discharges the gas through the nozzle as a result of driving the vibrating member thereby enabling cooling of a heat sink. The housing may also comprise a second chamber also having a nozzle. In this case, when air is discharged from the nozzles, sound is generated independently from the nozzle associated with the first chamber and the nozzle associated with the second chamber. Since the sound waves that are generated at the nozzles have opposite phases, the sound waves weaken each other. This makes it possible to further reduce noise. It is desirable that the volumes of the first and second chambers are the same. This causes the amount of air that is discharged to be the same, so that noise is further reduced.

However, a drawback with previously proposed systems, e.g. as disclosed in US 2006/0237171, is that they require subsonic frequencies or mechanical symmetry to achieve satisfactory noise reduction. This limits the range of applications as there often are inherent mechanical.

SUMMARY OF THE INVENTION

In view of the above, an object of the invention is to solve or at least reduce the problems discussed above. In particular, an object is to extend the range of applications for these cooling devices by providing a way to reduce the sound level in a pulsating cooling system also for systems where mechanical symmetry is not practical while maintaining a low cost.

According to an aspect of the invention, there is provided a cooling device using pulsating fluid for cooling of an object, comprising a transducer having a membrane adapted to generate pressure waves at a working frequency ($f_w$), and a cavity enclosing a first side of the membrane, the cavity having at least one opening adapted to emit a pulsating net output fluid flow towards the object, wherein the opening is in communication with a second side of the membrane. The cavity is sufficiently small to prevent fluid in the cavity from acting as a spring in a resonating mass-spring system in the working range. This is advantageous as a volume velocity ($u_1$) of the membrane is essentially equal to a volume velocity at the opening. Furthermore, a volume velocity ($u_1$) at the opening is essentially equal to a volume velocity ($u_1'$) at the second side of the membrane, apart from a minus sign. Thus, at the working frequency the pulsating net output fluid can be largely cancelled due to the counter phase with the pressure waves on the second side of the membrane resulting in a close to zero far-field volume velocity. Thus a low sound level is achieved, at a low cost, without requiring mechanical symmetry.

A "transducer" is here a device capable of converting an input signal to a corresponding pressure wave output by actuating a membrane. This input signal may be electric, magnetic or mechanical. For instance, a suitable dimensioned electrodynamic loudspeaker may be used as a transducer. The working frequency refers to the frequency of the signal fed to the transducer. Furthermore, a "membrane", here includes any type of flexible or rigid membrane, diaphragm, piston, etc. As an example a loudspeaker membrane could be used.

The cooling device according to the present invention may be used for cooling a large variety of objects. The fluid may be air or any other gaseous fluid.

The invention is based on the idea that by having the volume of the cavity sufficiently small, the fluid therein can be considered as essentially incompressible and is prevented from acting as a spring in a resonating mass-spring system. An example of such a resonating system, which is prevented by the invention, is a Helmholtz resonator. As the fluid is essentially incompressible the volume velocity at the opening and the rear of the transducer will be essentially equal (apart from the sign). Thereby, at the working frequency the pulsating net output fluid can be largely cancelled due to the counter phase with the pressure waves on the second side of the membrane resulting in a close to zero far-field volume velocity. Thus a lower sound level is achieved, at a low cost, without requiring mechanical symmetry.

The opening can be connected to the cavity via a channel, allowing more design freedom, as the channel can be formed to direct the fluid stream towards a desired location and in a desired direction. To prevent the channel from acting as a transmission line, the channel preferably has a length ($L_p$) which is less than $\lambda/20$, where $\lambda$ is the wave length in the fluid corresponding to $f=f_w$.

The Helmholtz frequency, $f_H$, of the cavity in combination with any channel is preferably larger than the working frequency, $f_w$, and more preferably $f_H>4\cdot f_w$.

The working frequency is preferably such that the fluid velocity and fluid displacement through the opening have a local maximum, and typically this occurs in a neighborhood of a resonance frequency of the device, i.e. a frequency corresponding to a local maximum of the electric input impedance of the device (the transducer in combination with the cavity, opening, and any channels). Typically the lowest such frequency is chosen. The working frequency ($f_w$) is preferably less than $1.2\cdot f_1$, where $f_1$ is the first low resonance peak in the impedance curve, and more preferably $f_w=f_1$.

The working frequency ($f_w$) is preferably below 60 Hz, and more preferably below 30 Hz.

Moreover, the electrical impedance of the device at $f_1$ is preferably designed to be 1.5-5 times greater, and most preferably around two times greater, than a DC-impedance of the transducer. This relationship between drive frequency impedance and DC-impedance has been found to result in especially advantageous results.

The area of the membrane, $S_1$, is preferably larger than the area of the opening, $S_p$, i.e. $S_1/S_p>1$, or more preferably $S_1/S_p>>1$. This results in that the volume velocity on both sides remains equal, whereas the velocity at the opening increases in order to promote vortex shedding. In other words it enables to reach a low $f_1$ while $f_s$ can be relatively high as is usual for small loudspeakers. Through the arrangement, a jet may form despite a modest excursion as the jet formation criterion reads: $T_{stroke}>r_p \cdot S_p/S_1$, where $T_{stroke}$ is the stroke of the transducer, $r_p$ is the radius of the opening, $S_p$ is the area of the opening, and $S_1$ is the area of the membrane.

Since the jet length is approximately 10 times the opening diameter, the preferable distance between opening and the cooled object is 2 to 10 times the opening diameter The cooling device according to the present invention may, furthermore, advantageously be comprised in an electronic device including electronic circuitry or in an illumination device.

Other objectives, features and advantages will appear from the following detailed disclosure, from the attached dependent claims as well as from the drawings.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION

Figure 1:
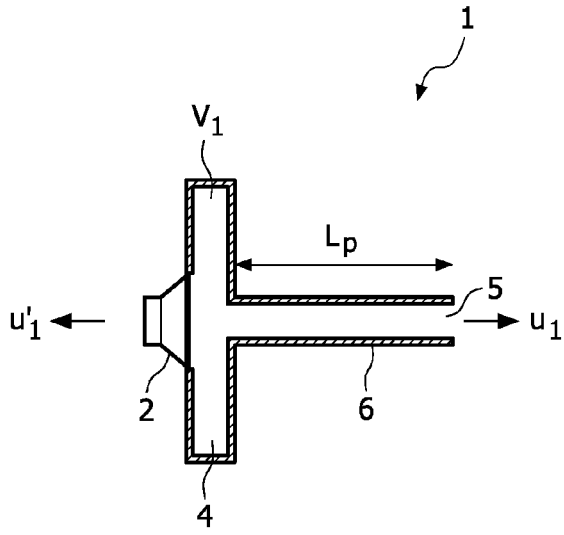
FIG. 1 illustrates a cooling device according to a first embodiment of the invention.

The cooling device 1 in FIG. 1 comprises a transducer 2 having a membrane adapted to generate pressure waves at a working frequency ($f_w$). The transducer 2 is here illustrated as a loudspeaker, but is not limited thereto. On the contrary any transducer capable of generating a pressure wave could be used. A cavity 4 is arranged in front of the transducer 2, thereby enclosing a first side of the transducer membrane. The fluid in the cavity 4 is here air. The cavity 4 is in communication with the environment outside the cavity through an opening 5. Furthermore, the opening is in communication with the rear of the transducer (i.e. the side of the membrane facing away from the cavity). The opening 5 is connected to the cavity 4 via a channel 6, having a uniform shape and size throughout its extension, here in the form of a cylindrical tube 6. However, the channel may be in a variety of shapes. For example, the channel may have a rectangular cross-section. Also, the cross-section may vary in shape and/or size along the extension of the channel.

To prevent the tube 6 from acting as a transmission line, the length ($L_p$) thereof is less than $\lambda/20$, where $\lambda$ is the wave length in the fluid corresponding to $f=f_w$. Furthermore, to avoid Helmholtz resonance, the dimensions of the cavity 4 and the associated tube 6 is selected so that the Helmholtz frequency, $f_H$, of the cavity 4 together with the tube 6 exceeds four times the working frequency $f_w$ of the transducer 2. If end effects are disregarded, the undamped Helmholtz frequency can be expressed as:

$$f_H \approx \frac{c_0}{2\pi}\sqrt{\frac{S_p}{L_p V_1}},$$

where $S_p$ is the cross-sectional area of the tube $L_p$ is the length of the tube $V_1$ is the volume of the cavity, and $c_0$ is the speed of sound in the gas.

The device is typically designed so that the first low resonance peak in the impedance curve, $f_1$, coincides with the working frequency of the transducer, $f_w$, i.e.

$$f_w = f_1 \approx \frac{f_s}{\sqrt{1+\frac{S_1^2}{S_p^2}\cdot\frac{\rho_0 L_p S_p}{m_1}}}$$

where $f_s$ is the resonance frequency of the loudspeaker without the volume of the cavity and the tube, $\rho_0$ is density of air, $S_1$ is the area of the transducer membrane, $m_1$ is the moving mass of the loudspeaker, $L_p$, is the length of the tube, and $S_p$ is the cross-sectional area of the tube.

According to an exemplifying embodiment, the following parameters were used:

Loudspeaker data:

$R_E$=5.6Ω(DC resistance)

$R_M$=0.56 Ns/m (mechanical resistance of loudspeaker suspension)

BI 5.5 N/A (motor force factor)

$S_1$=0.00126 $m^2$ (radiating surface of loudspeaker)

$D_1$=0.04 m (eff. diameter of loudspeaker)

$f_s$=84 Hz (free resonance frequency of loudspeaker)

$m_1$=0.0044 kg (moving mass of loudspeaker)

Other data:

$V_1$=5 $cm^3$ (cavity volume)

$L_p$=15 cm (tube length)

$S_p$=0.00001964 $m^2$ (internal tube area)

$D_p$=5 mm (internal tube diameter)

$R_p$=0.00021 Ns/m (mechanical resistance of the tube)

Figure 2:
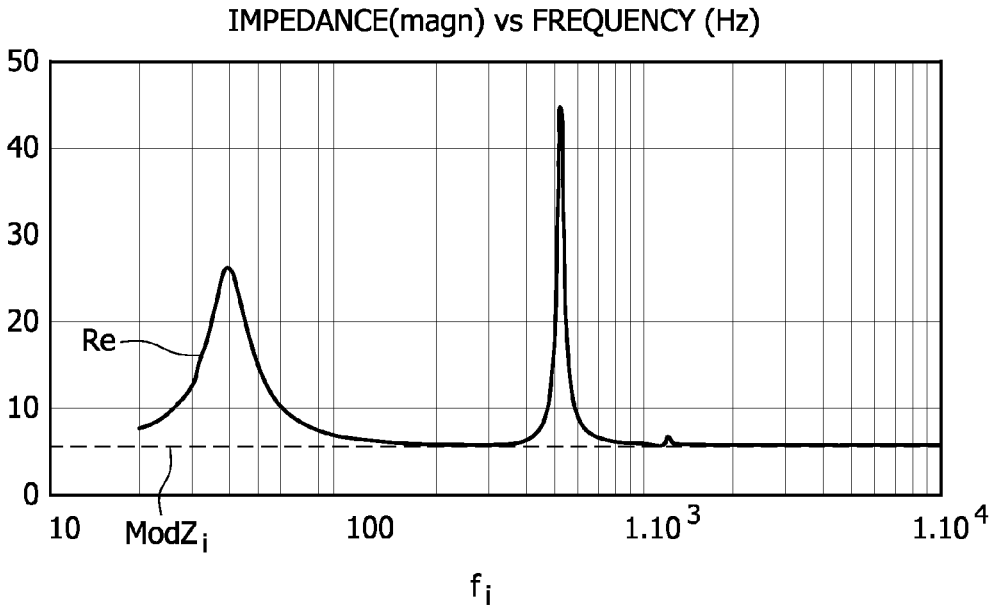
FIG. 2 illustrates the system electrical impedance.

In FIG. 2, the system electrical impedance is illustrated as a function of frequency for the exemplifying embodiment. The first peak at 40 Hz is $f_1$, and at 250 Hz is the Helmholtz frequency. The electrical impedance at $f_1$ is preferably equal to twice that of the voice coil impedance at DC.

In operation the transducer 2 actuates the membrane at the working frequency $f_w$. The membrane generates pressure waves in the cavity 4 resulting in a pulsating net output fluid flow at the opening 5, which can be used to cool an object such as, for example, an electric circuit or an integrated circuit. Other examples would be hotspot cooling of power devices such as Light Emitting Diode (LED) lamps and large-area cooling of LED luminaires or backlights in flat TVs.

The volume velocity $u_1$ of the net output fluid flow at the opening 5 is essentially equal to the volume velocity $u_1'$ at the rear of the loudspeaker 2 apart from a minus sign. The rear of the loudspeaker here refers to the side of the membrane facing away from the cavity. The opening 5 is in communication with the rear of the loudspeaker. Thus, at the working frequency, the pulsating net output fluid is largely cancelled due to the counter phase with the pressure waves at the rear of the loudspeaker resulting in a close to zero far-field volume velocity. The result is a reduced sound level.

Figure 3:
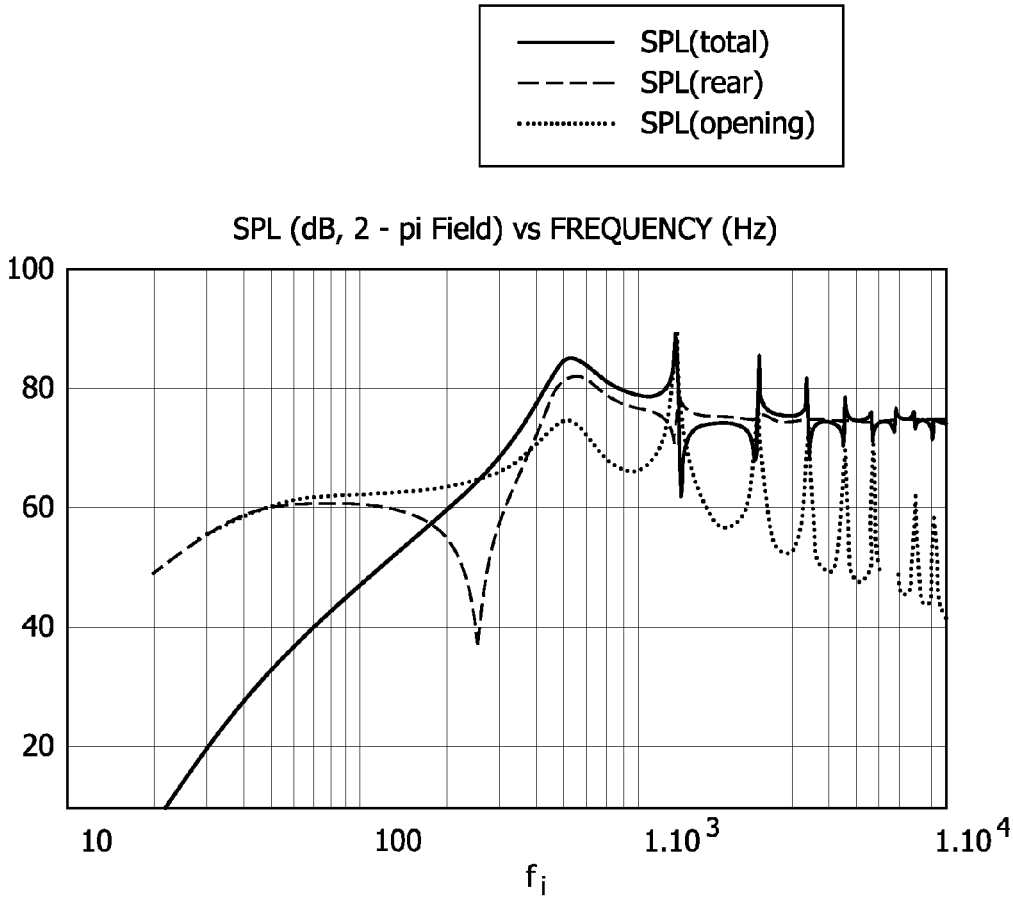
FIG. 3 illustrates the Sound Pressure Level (SPL) for the system.

An example of the Sound Pressure Level (SPL) and impedance of the system is illustrated in FIG. 3. The solid line is the total SPL (opening+rear) which is the sum of the thick dotted line (which is the rear SPL) and the thin dotted line (which is the opening SPL). Since the rear SPL and the opening SPL are substantially, at least in the working range, of similar magnitude but opposite phase they cancel each other substantially.

Figure 4:
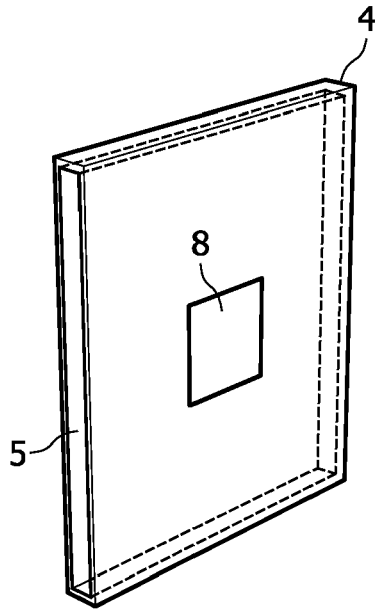
FIG. 4 illustrates a cooling device according to a second embodiment of the invention.

Another embodiment of the present invention is illustrated in FIG. 4. Here five planar walls form a rectangular cavity 4 leaving one side open. The open side here forms the opening 5 of the cavity. A transducer actuates a membrane 8 arranged in one of the walls as illustrated in FIG. 4. The membrane 8 could alternatively be arranged in any of the other walls. Further, in an alternative embodiment, more than one side of the rectangular cavity could be left open.

Figure 5:
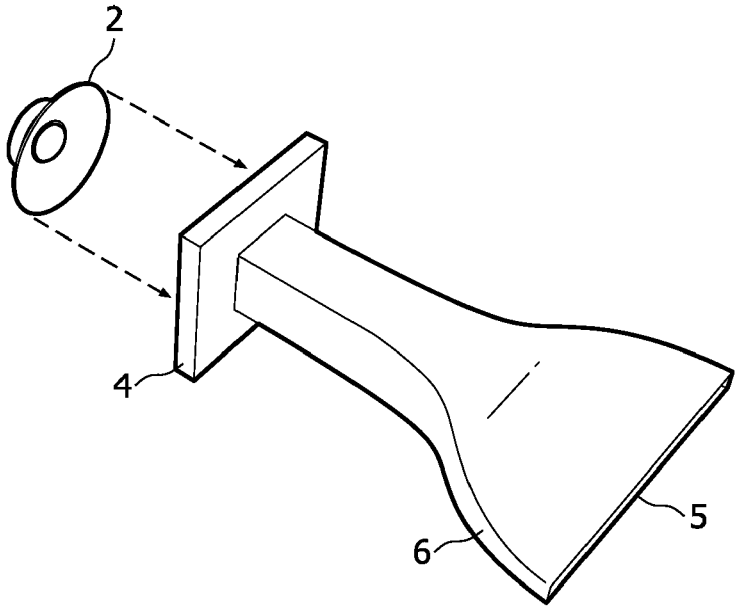
FIG. 5 illustrates a cooling device according to a third embodiment of the invention.

According to another embodiment, the channel 6 is wider at the opening 5 than it is at the cavity 4, resulting in a funnel-shaped channel as illustrated in FIG. 5. The area of the cross-section of the funnel-shaped channel may vary along its extension, but preferably the cross-sectional area is the same at any point of the channel, so that the opening is narrow in one dimension an relative wide in the other dimension. This enables cooling of a wider area while maintaining a high velocity, and thus efficient cooling.

Figure 6:
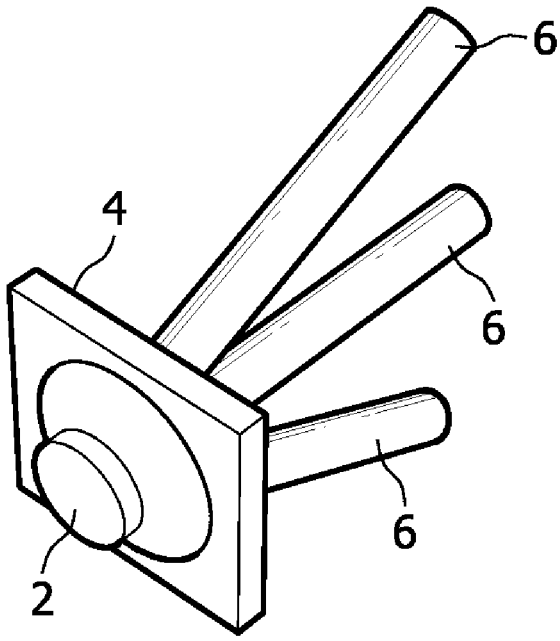
FIG. 6 illustrates a cooling device according to a fourth embodiment of the invention.

According to yet another embodiment, the cavity has a plurality of openings. Each opening may be connected to the cavity via a tube 6 as exemplified in FIG. 6. The openings may be directed in essentially the same direction or in different directions in order to simultaneously cool several objects. Furthermore, the openings may be in substantially the same plane or in different planes.

It is recognized that the figures relating to the embodiments described above are merely illustrative. Thus, the illustrated proportions may not accurately reflect the proportions in a real application. For example, the area of the loudspeaker membrane may have to be larger compared to the area of the cross-section of the tube than indicated by the figures to meet the jet formation criterion in a real application.

The invention has been described above with reference to a few embodiments. However, as is readily appreciated by a person skilled in the art, other embodiments than the ones disclosed above are equally possible within the scope of the invention, as defined by the appended claims. For instance, it is noted that the principle is not limited to any particular fluid, even though the present description mainly has been based on a device operated in air, i.e. a device that generates oscillating air streams. Further, although the cavity in the illustrated examples has been arranged in front of the transducer, the direction of the transducer is of minor importance and might be reversed. Furthermore, the shape of the cavity and channels are merely exemplifying, and may take arbitrary shape. For example, even though the channel of the exemplifying embodiments are essentially straight, the tube may also be substantially coil shaped, or have some other arrangement, such as a labyrinth, more compact than a straight tube, enabling a space-saving cooling device to be realized. Also, the described embodiments may be combined.

The invention claimed is:

1. A cooling device using pulsating fluid for cooling of an object, the device comprising:

a transducer having a membrane adapted to generate pressure waves at a working frequency ($f_w$), and a cavity enclosing a first side of said membrane, said cavity enclosing the first side of said membrane having at least one opening adapted to emit a pulsating net output fluid flow towards said object, the at least one opening of cavity enclosing the first side of said membrane connected to the cavity via a channel, said channel having a length ($L_p$) less than $\lambda/20$, where $\lambda$ is the wavelength in the fluid corresponding to $f=f_w$, wherein the at least one opening of the cavity enclosing the first side of said membrane is in gaseous fluid communication with a second side of said membrane, and wherein said cavity is sufficiently small to prevent fluid in said cavity from acting as a spring in a resonating mass-spring system in the working range, such that a volume velocity (u1) at the at least one opening of the cavity enclosing the first side of said membrane is substantially equal to a volume velocity (u1') at the second side of the membrane.

2. A cooling device according to claim 1, wherein a Helmholtz frequency ($f_H$) of the cavity in combination with any channel is larger than the working frequency ($f_w$).

3. A cooling device according to claim 1, wherein the working frequency ($f_w$) is less than $1.2 \cdot f_1$, where $f_1$ is a first low resonance peak in an impedance curve.

4. A cooling device according to claim 1, wherein said working frequency ($f_w$) is below 60 Hz.

5. A cooling device according to claim 1, wherein a systems electrical impedance at $f_1$ is about two times greater than a DC-impedance of the transducer.

6. A cooling device according to claim 1, wherein the area of the membrane ($S_1$) is larger than the area of the opening ($S_p$).

7. A cooling device according to claim 1, wherein a Helmholtz frequency ($f_H$) of the cavity in combination with any channel is at least four times larger than the working frequency ($f_w$).

8. A cooling device according to claim 1, wherein the working frequency ($f_w$) substantially equals a first low resonance peak in an impedance curve.

* * * * *